US008454300B2

(12) United States Patent
Stagg et al.

(10) Patent No.: US 8,454,300 B2
(45) Date of Patent: Jun. 4, 2013

(54) OPEN-BLADE ENGINE-COOLING FAN SHROUD GUIDE VANES

(75) Inventors: Jonathan Bradley Stagg, Bellevue, MI (US); James W. Bailey, Marshall, MI (US)

(73) Assignee: BorgWarner Inc., Auburn Hills, MI (US)

( * ) Notice: Subject to any disclaimer, the term of this patent is extended or adjusted under 35 U.S.C. 154(b) by 420 days.

(21) Appl. No.: 12/936,424

(22) PCT Filed: Apr. 8, 2009

(86) PCT No.: PCT/US2009/039848

§ 371 (c)(1), (2), (4) Date: Oct. 5, 2010

(87) PCT Pub. No.: WO2009/129093

PCT Pub. Date: Oct. 22, 2009

(65) Prior Publication Data

US 2011/0044809 A1 Feb. 24, 2011

Related U.S. Application Data

(60) Provisional application No. 61/124,206, filed on Apr. 15, 2008.

(51) Int. Cl.
*F03B 11/00* (2006.01)

(52) U.S. Cl.
USPC ..... 415/58.5; 415/208.2

(58) Field of Classification Search
USPC ..... 415/52.1, 57.2, 57.4, 58.3, 58.4, 415/58.5, 58.6, 28.7, 200, 208.1, 208.2, 209.1, 415/225; 416/169 A, 183, 185, 189, 235, 416/237
See application file for complete search history.

(56) References Cited

U.S. PATENT DOCUMENTS 5,489,186 A * 2/1996 Yapp et al. ..... 415/58.7

* cited by examiner

*Primary Examiner* — Edward Look
*Assistant Examiner* — Juan G Flores

(57) ABSTRACT

To make manifest the above noted desire, a revelation of the present invention is brought forth. A fan assembly (7) is provided including a hub (10) with a plurality of projecting fan blades (12). A recirculating flow element (18) is provided which is generally forward adjacent an outer diameter of the fan blades (12). A plurality of guide vanes (22) are positioned within the recirculating flow element (18). The guide vanes (22) have an inlet angle (24) that is nearly tangential with an outer diameter surface (15) of the recirculating flow element (18). The guide vanes (22) have an outlet angle (26) which is nearly radial along an inner diameter surface (17) of the recirculating flow element (18).

24 Claims, 5 Drawing Sheets

OPEN-BLADE ENGINE-COOLING FAN SHROUD GUIDE VANES

This application is a National Stage of International Application No. PCT/US2009/039848, filed Apr. 8, 2009. This application claims priority to U.S. Provisinoal Patent Application No. 61/124,206 filed on Apr. 15, 2008. The disclosures of the above applications are incorporated herein by reference.

FIELD OF THE INVENTION

The field of the present invention is that of fan assemblies. More particularly, the field of the present invention is that of open blade fan assemblies, particularly useful for automotive engine cooling applications.

BACKGROUND OF THE INVENTION

Engine cooling fans develop static pressure across the fan such that regions ahead of the fan are at significantly lower pressure than regions behind the fan. Practical operations of fans used in under-hood engine cooling functions dictates minimum clearances between rotating and stationary components to ensure safe, durable functioning throughout the life of the vehicle. The pressure rise developed across the fan drives leakage flow through the gaps occurring between the fan's blade tips or rotating ring, if present, and the stationary surfaces of the shroud.

In open-blade fans, this leakage flow encounters the tip gap along the entire tip region of each blade from leading edge to trailing edge and enters the gap region having a very high tangential velocity component. As the leakage flow progresses through the gap region, the vicious drag of the fan blade tips continues to strengthen this vertical flow until finally it reaches the exit of the gap region now being radially outward from the blades' leading edge tips. This strong vortex continues to propagate forward, and if not constrained will continue flowing upstream of the fan tangentially and radially outward into the shroud region (adjacent a radiator upstream of the fan assembly) until the primary flow movement recaptures it and pulls it back into the fan passage.

When the recirculation flow reenters the fan passage, it possesses a very high tangential component, which is at great odds with the velocity and direction of the primary incoming flow entering the fan passage through the fan's inlet nozzle. As the tangentially-oriented recirculation flow mixes with the mostly axial primary flow, a vortex is formed just in front of the blade's leading edge at the tip.

Since the leading edge was designed for the primary flow velocity condition, the vortex encountered by the blade is misaligned relative to the intended inlet vector. The above noted action causes the tip region to stall and resulting low relative-momentum flow tends to "hang up" in the blade tip region reducing flow-rate and static pressure and increasing drag and thereby causing efficiency losses.

It is desirable to provide a fan assembly wherein the losses from recirculating leakage flow can be reduced.

SUMMARY OF THE INVENTION

To make manifest the above noted desire, a revelation of the present invention is brought forth. In a preferred embodiment, the fan assembly of the present invention has a hub with a plurality of projecting fan blades. A recirculating flow element is provided which is generally forward adjacent an outer diameter of the fan blades. A plurality of guide vanes are positioned within the recirculating flow element. The guide vanes have an inlet angle that is nearly tangential with an outer diameter surface of the recirculating flow element. The guide vanes have an outlet angle which is nearly radial along an inner diameter surface of the recirculating flow element.

Further features of the present invention will be revealed by a review of the invention as it is provided in the accompanying drawings and detailed description.

DETAILED DESCRIPTION OF THE INVENTION

Figure 1:
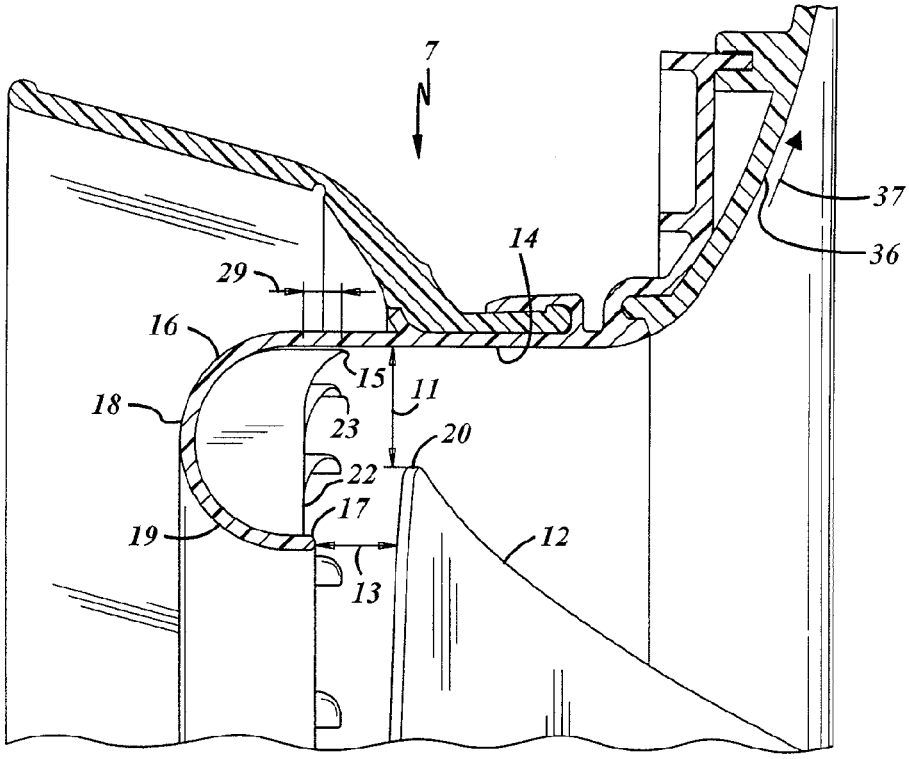
FIG. 1 is a partial sectional view of a fan assembly according to the present invention taken parallel to the fan's rotational axis.
Figure 2:
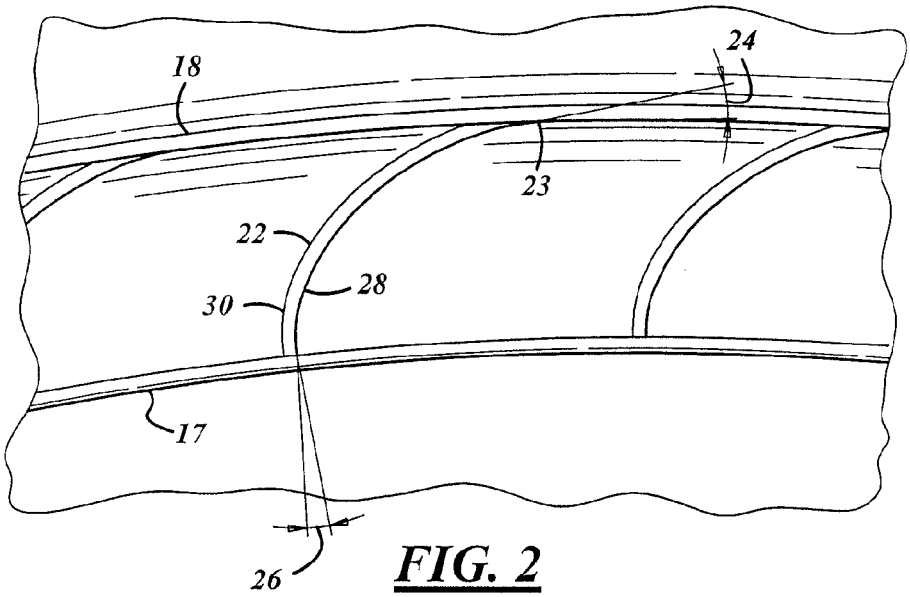
FIG. 2 is a rear plan view of a element of the fan assembly shown in FIG. 1 with fan blades removed for clarity of illustration.
Figure 3:
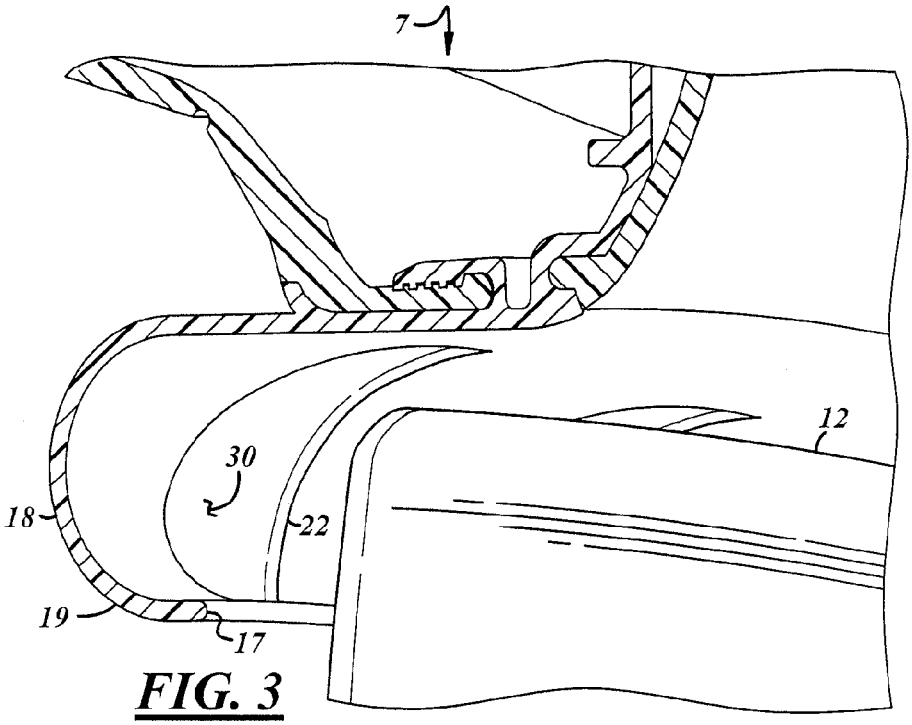
FIG. 3 is an enlarged sectional view in a plane angled from the fan's rotational axis illustrating guide vanes and a shroud recirculating flow element shown in FIGS. 1 and 2.
Figure 4:
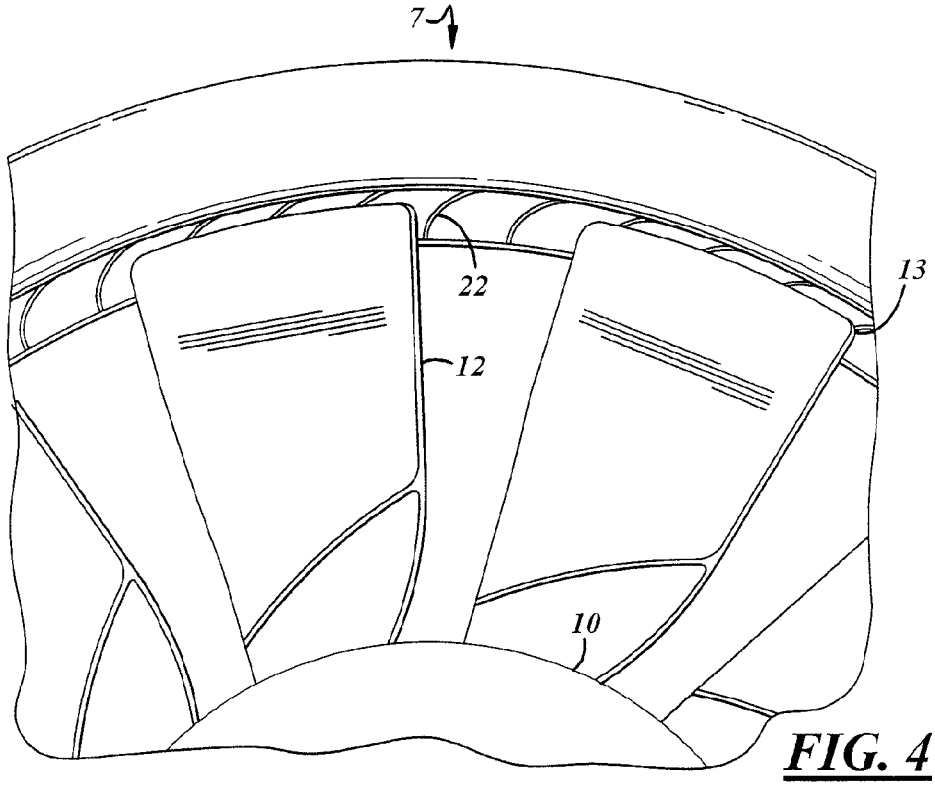
FIG. 4 is a rear plan view of a element of the fan assembly shown in FIG. 1.

Referring to FIGS. 1-4, an open blade fan assembly 7 of the present invention has a rotative hub 10. Projecting from the hub 10 is a plurality of fan blades 12. Radially spaced from the fan blades 12 is a generally cylindrical outer shroud 14. Extending forwardly from the outer shroud 14 is a forward shroud 16. A portion of the forward shroud 16 provides a recirculating flow element 18. The recirculating flow element 18 typically has conically shaped curvilinear cross section typically close to that of a semi-circle with a slight coterminous lead in to the outer shroud 14. A front end of the recirculating flow element 18 forms an inlet nozzle 19 for the fan assembly. The shroud exit element 36 is coincident or parallel with the direction 37 of air flowing from a rear edge 13 of the fan blade.

The recirculating flow element 18 is typically forward adjacent of a fan blade outer radial diameter leading tip 20. The fan blades 12 have a radial clearance or tip gap 11 between their leading tip 20 and the outer shroud 14. The tip gap 11 will typically be in a range of 6 mm to 10 mm. The recirculating flow element 18 will typically have an axial clearance 13 with the blade 12 in range of 6 mm to 25 mm.

Thereby, in most applications, the axial clearance 13 will vary at a ratio of 5.2 to 0.6 of the tip gap 11. As mentioned previously, the recirculating flow element 18 typically has a cross-sectional shape close to that of a semi-circle with a diameter or major dimension which will typically vary from 25 mm to 50 mm. Accordingly, the diameter or major dimension of the recirculating flow element 18 will have a ratio of 8.3 to 2.5 of the tip gap 11. The recirculating flow element 18 as shown in FIG. 1 has an entry outer diameter surface 15 and an exit inner diameter surface 17. At the recirculating element's inner diameter surface 17, the recirculating flow element projects generally in an axial direction.

Positioned within the circulating flow element 18 are a plurality of guide vanes 22. The guide vanes 22 have an inlet angle 24 measured from the tangential surface of the outer diameter of the recirculating flow element of the shroud that is nearly tangential. As shown, the inlet angle 24 is typically 20° or less. The outlet angle 26 of the guide vane 22 is nearly radial and typically is plus or minus 20° from the radial at a position at recirculating flow element inner diameter surface 17. The guide vanes 22 have a curvilinear shape which is typically conic and as shown is a portion of an ellipse. However, other curvilinear shapes such as a parabolas or spirals can also be utilized. It is preferable that the shape of the guide vanes 22 be that of a continuous curve.

The guide vanes 22 have an axial clearance with the leading tip 20 that slightly decreases by an amount 29 from an inner diameter of the guide vane 22 to its outer diameter. Dimension 29 will typically be less than 50% of the diameter or major dimension of the recirculating flow element 18.

Figure 5:
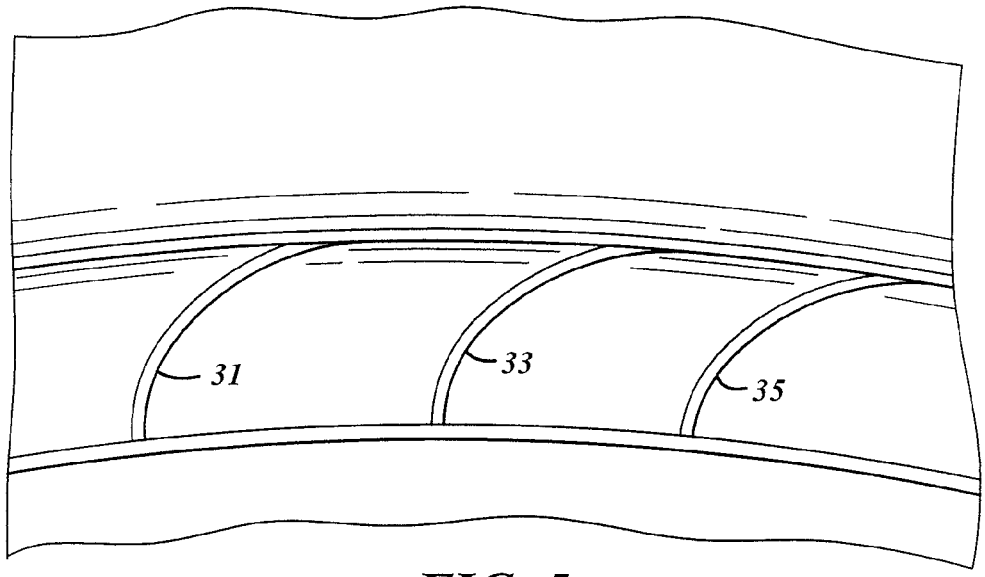
FIG. 5 is a view similar to that of FIG. 2 wherein angular spacing between the guide vanes varies along the diameter of the recirculating flow element.

The guide vanes 22 are typically fabricated from a polymeric material and can be integrally formed with the recirculating flow element 18 of the shroud. The surfaces 28 and 30 of the guide vanes are typically linearly extruded allowing the injection molded manufacture of the guide vanes 22 in a simple two piece mold without the requirement of complex cams, sliders or other mechanisms. The total guide vane count can be specified to be that of a prime number to reduce undesirable noise or vibration. Again, to reduce noise or vibration, the spacing may be varied between given guide vanes 31, 33 and 35 as shown in an alternative embodiment shown in FIG. 5.

The function of the recirculating flow element 18 is to collect the majority of the recirculation flow leaving the pressure side of each blade tip, allowing it to continue tangentially "centrifuging" so that when the combined leakage flow (collected over the entire blade tip region from trailing edge to leading edge) encounters the shroud guide vanes 22 it is configured to enter along the surface of the outer shroud where the inlet angles 24 of the guide vanes 22 are designed to smoothly capture it.

The function of the shroud vane 22 is to smoothly "capture" the leakage flow as it enters the gap region—this is why the vane's leading edge 23 is substantially tangential near the recirculating element 18 outer diameter surface 15—and then to gently turn the flow direction from tangential to radial and axial—hence the substantially radial trailing edge. The above noted action effectively removes the tangential component from the recirculation flow and reintroduces it back into the fan passage in correct alignment with the incoming primary flow stream.

Figure 6:
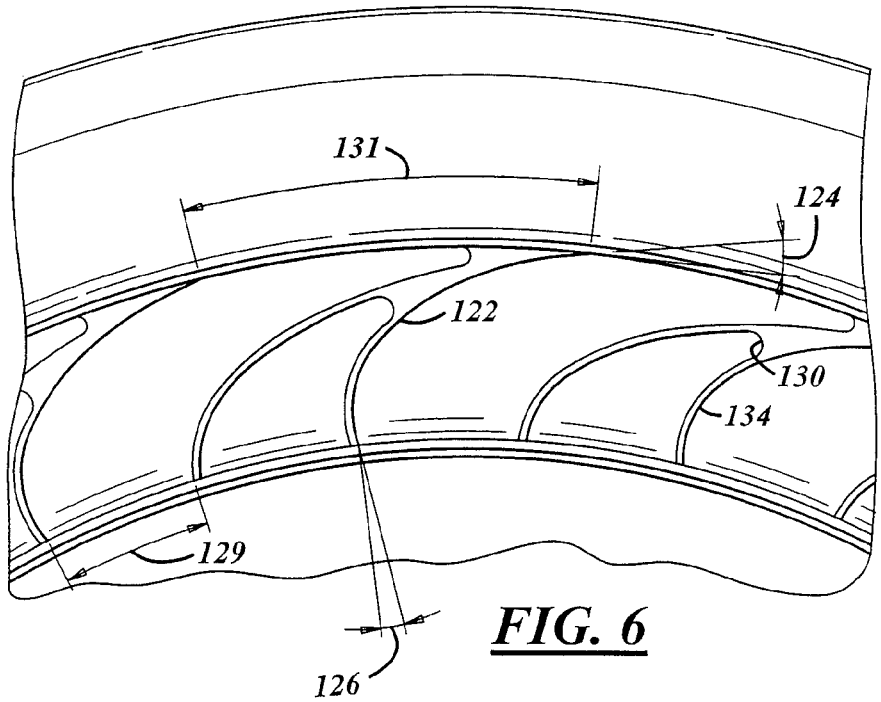
FIG. 6 is view similar to FIG. 2 of alternate preferred embodiment fan assembly of the present invention having recirculating flow element guide vanes having circumferential angular spacing between separate guide vanes angularly decreasing from the guide vane's outer to inner diameter.

Referring to FIG. 6, an alternate preferred embodiment guide vane 122 according to the present invention is provided. The guide vanes 122 have a split 130 leading to a deflected out region 134. The guide vane 122 inlet angle 124 between the outer tangential surface of the circulating flow element 18 is similar in its degree range as previously described inlet angle 24. The exit angle 126 is similar in measurement to the previously described exit angle 26 for guide vane 22. Guide vanes 122 have an outlet circumferential angle 129 which is diminishing from an inlet circumferential angle 131 by approximately one-half. As a consequence of the diminishing circumferential angle, the air captured by adjoining vanes 122 encounters a nozzle type effect increasing in velocity as compared with the embodiment shown in FIG. 1.

Figure 7:
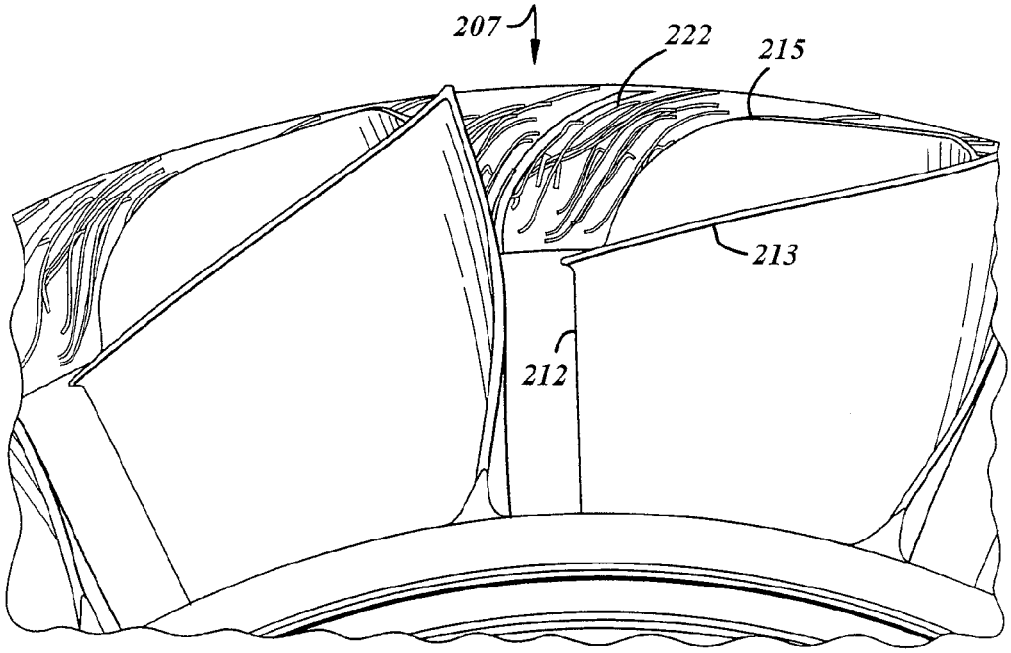
FIG. 7 is a view similar to that of FIG. 4 illustrating an alternative preferred embodiment of the present invention wherein the blades of the fan have winglets and bladelets.
Figure 8:
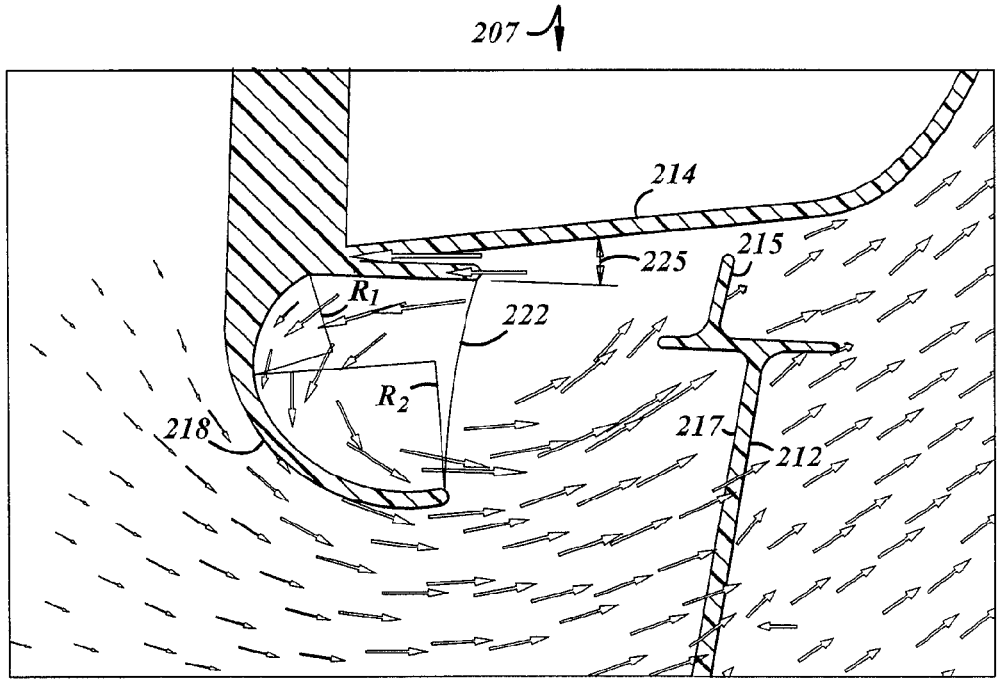
FIG. 8 is an axial sectional view of the fan assembly shown in FIG. 7.

To improve the efficiency of the fan assembly of the present invention even further, the present invention is provided with a fan assembly 207 (FIGS. 7 and 8) having a recirculating flow element 218 with guide vanes 222. Recirculating element 218 has a compound arc shape defined by a plurality of radiuses R1 and R2. An outer shroud 214 is conically expanded having an angle 225 varying from the axial direction from 0 to 45 degrees. Additionally, the fan 207 assembly has blades 212 which additionally have winglets 213 and bladelets 215. The winglets 213 help prevent the circumferential escape of the air against the face of the fan blade 212. The bladelet 215 allows the attack angle of the blade along its extreme end to vary as compared with the remainder of the blade 212 functioning to improve the performance of the fan assembly 207.

Figure 9:
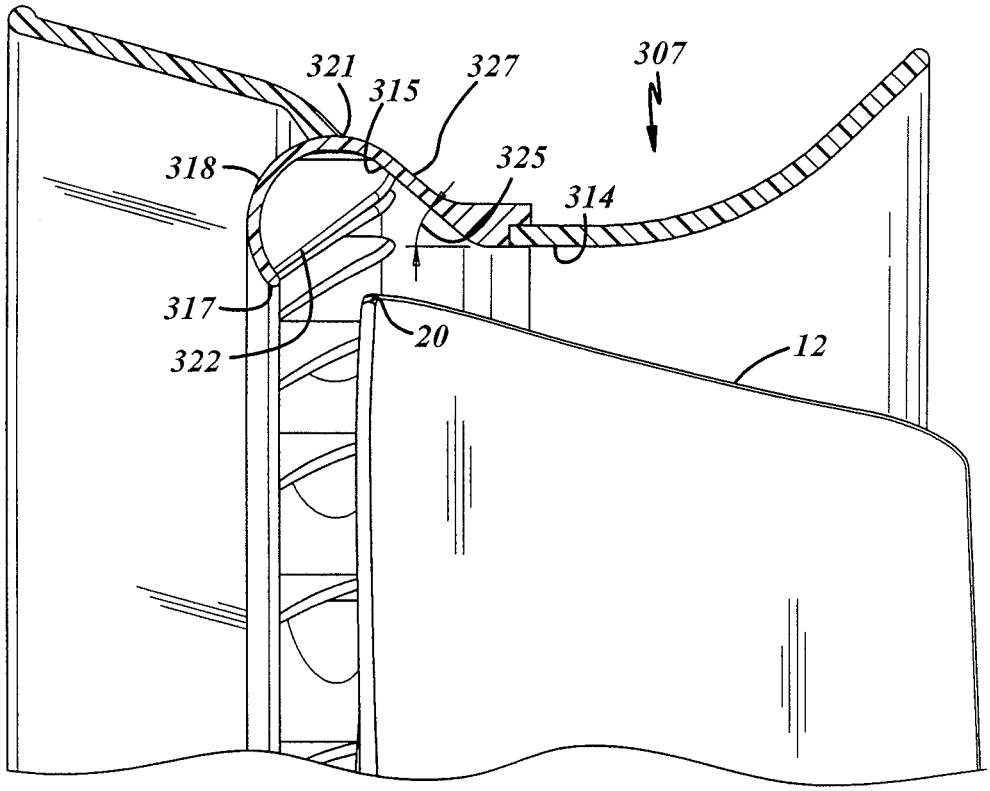
FIG. 9 is a view similar to that of FIG. 1 of an alternative preferred embodiment of the present invention wherein the recirculating flow element of the fan assembly is positioned angularly and radially outward from the position of the recirculating flow element shown in the fan assembly shown in FIG. 1.
Figure 10:
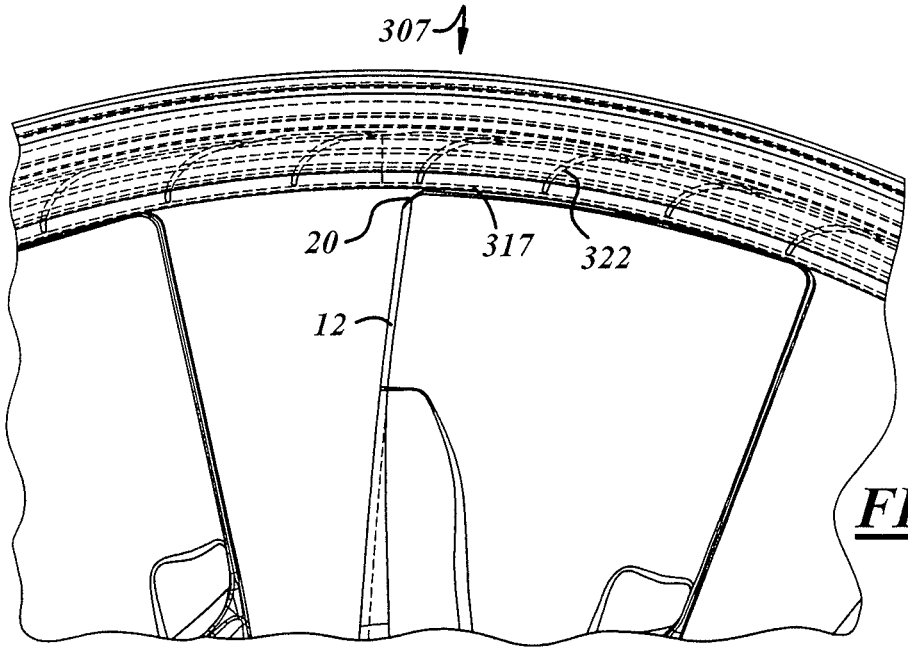
FIG. 10 is a rear plan view of a recirculating flow element of the fan assembly shown in FIG. 9.

Referring to FIGS. 9 and 10, an alternate preferred embodiment 307 fan assembly is provided. The fan assembly 307 has fan blades 12 with fan tips 20 as previously described for the fan assembly 7 shown in FIG. 1. Additionally, the fan assembly 307 has an outer shroud 314. The shroud 314 has a lead in section 327 that is angled from an axial direction by an angle 325 which is typically in the range of 0 to 45 degrees. The lead in section 327 is joined to the remainder of the recirculating flow element 318. The guide vanes 322 are very similar to the guide vanes 22 as previously described with the embodiment of the fan assembly 7. However, the recirculating flow element 318 is angled such that its inner diameter exit surface 317 is spaced dimensionally radially outward of the fan leading tip 20. The recirculating flow element outer radius 315 is slightly radially inward of the radial apex 321 of the recirculating flow element 318 due to its tilted position. Accordingly, the effective radial outside diameter 315 and the inner diameter 317, are both dimensionally radially outward from the leading edge tip 20 unlike the inner and outer diameter surfaces 17 and 15 of the recirculating flow element 18 shown in FIG. 1 which are juxtaposed radially dimensionally by the blade leading edge 20. The embodiment of fan assembly 307 has been found most useful in lower pressure restrictive applications of the fan assembly. Since the recirculating flow element inner diameter surface 317 is greater than the radius of the fan leading edge tip 20, the shroud assembly can be assembled with the remainder of the fan assembly from either direction thereby causing the fan assembly 307 to have more options for assembly than that of the fan assembly 7 as previously described.

The description of the invention is merely exemplary in nature and, thus, variations that do not depart from the gist of the invention are intended to be within the scope of the invention. Such variations are not to be regarded as a departure from the spirit and scope of the invention.

The invention claimed is:

1. An open blade fan assembly comprising:

a fan having a hub with a plurality of projecting fan blades;

a recirculating flow element generally forward adjacent an outer diameter of said fan blades;

a plurality of guide vanes positioned within said recirculating flow element having an inlet angle nearly tangential, in the circumferential direction, with an outer entry diameter radial surface of said recirculating flow element and having an outlet angle nearly radial along an inner exit diameter surface of said recirculating flow element.

2. A fan assembly as described in claim 1 wherein said inlet angle is generally 20° or less.

3. A fan assembly as described in claim 1 wherein said outlet angle is generally plus or minus radial 20° or less.

4. A fan assembly as described in claim 1 wherein there are a prime number of said guide vanes.

5. A fan assembly as described in claim 1 wherein the spacing between at least two of said vanes is not equal to the spacing between two other said guide vanes.

6. A fan assembly as described in claim 1 wherein said fan blades have winglets.

7. A fan assembly as described in claim 1 wherein said fan blades have bladelets.

8. A fan assembly as described in claim 1 wherein said recirculating flow element forms an inlet nozzle for said fan assembly.

9. A fan assembly as described in claim 1 wherein said guide vanes are integrally molded with said recirculating flow element.

10. A fan assembly as described in claim 9 wherein said guide vanes are fabricated from a polymeric material.

11. A fan assembly as described in claim 1 wherein said guide vanes are molded and wherein said guide vanes have linearly extruded surfaces.

12. A fan assembly as described in claim 1 wherein said guide vanes circumferentially angularly decrease in space there between from inlet to outlet.

13. A fan assembly as described in claim 1 wherein a shroud for said fan assembly has an exit element substantially parallel or coincident with the air flow being ejected from trailing edges of tips of said fan blade tips.

14. A fan assembly as described in claim 1 wherein said recirculating flow element is joined to a generally cylindrical outer shroud element.

15. A fan assembly as described in claim 1 wherein a major dimension of said recirculation flow element varies at a ratio from approximately 8.3 to 2.5 of a tip gap of said fan assembly.

16. A fan assembly as described in claim 1 wherein an axial clearance of said fan blade varies at a ratio of approximately 5.2 to 6 of a tip gap of said a tip gap of said fan assembly.

17. A fan assembly as described in claim 1 wherein said recirculating flow element is joined to a conical outer shroud element.

18. A fan assembly as described in claim 1 wherein said recirculating flow element is angled from an outer shroud element.

19. A fan assembly as described in claim 1 wherein said recirculating flow element inner diameter is dimensionally radially outward of radial tip of said fan blades.

20. A fan assembly as described in claim 1 wherein said guide vanes have a curvilinear shape.

21. A fan assembly as described in claim 1 wherein an axial clearance of said guide vanes with respect to a tip of said fan blades decreases radially outward of said guide vanes.

22. A fan assembly as described in claim 1 wherein said recirculating flow element has a compound radius shape.

23. An open blade fan assembly comprising:

a fan having a hub with a plurality of projecting fan blades;

a recirculating flow element generally forward adjacent an outer diameter of said fan blades, said recirculating flow element having outer entry and inner exit diameters radially dimensionally juxtaposed by an outer diameter of said fan blades; and a plurality of curvilinear guide vanes with liner extruded surfaces positioned within said recirculating element having an inlet angle generally 20° or less tangential, in the circumferential direction, with an outer diameter surface of said recirculating element and having an outlet angle generally 20° plus or minus radial along an inner diameter surface of said recirculating flow element.

24. An open blade fan assembly comprising:

a fan having a hub with a plurality of projecting fan blades;

a recirculating flow element generally forward adjacent an outer diameter of said fan blades, an inner diameter of said recirculating element being greater than an outer diameter of said fan blades; and a plurality of curvilinear guide vanes positioned within said recirculating flow element having an inlet angle generally 20° or less, in the circumferential direction, with an outer entry diameter surface of said recirculating element and having an outlet angle generally plus or minus 20° radial along an inner diameter surface of said recirculating flow element.

* * * * *